US011466652B2

(12) United States Patent
Primus et al.

(10) Patent No.: US 11,466,652 B2
(45) Date of Patent: Oct. 11, 2022

(54) FUEL INJECTOR HAVING A SELF-CONTAINED REPLACEABLE PILOT VALVE ASSEMBLY

(71) Applicant: CUMMINS INC., Columbus, IN (US)

(72) Inventors: Raymond V. Primus, Indianapolis, IN (US); Ryan S. Gray, Jr., Farmington Hills, MI (US)

(73) Assignee: CUMMINS INC., Columbus, IN (US)

( * ) Notice: Subject to any disclaimer, the term of this patent is extended or adjusted under 35 U.S.C. 154(b) by 66 days.

(21) Appl. No.: 15/622,541

(22) Filed: Jun. 14, 2017

(65) Prior Publication Data

US 2018/0363616 A1 Dec. 20, 2018

(51) Int. Cl.

| | |
|---|---|
| ***F02M 63/00*** | (2006.01) |
| ***F02M 61/16*** | (2006.01) |
| ***F02M 47/02*** | (2006.01) |
| ***F02M 51/06*** | (2006.01) |

(52) U.S. Cl.

CPC ..... *F02M 63/0029* (2013.01); *F02M 47/027* (2013.01); *F02M 51/061* (2013.01); *F02M 61/168* (2013.01); *F02M 2200/28* (2013.01); *F02M 2200/708* (2013.01); *F02M 2200/8076* (2013.01)

(58) Field of Classification Search

CPC ..... F02M 63/0026; F02M 63/0029; F02M 63/0031; F02M 63/0033

See application file for complete search history.

(56) References Cited

U.S. PATENT DOCUMENTS

| | | | | |
|---|---|---|---|---|
| 4,907,748 | A * | 3/1990 | Gardner | F02M 51/0603 239/584 |
| 6,695,232 | B2 | 2/2004 | Dallmeyer et al. | |
| 8,291,927 | B2 | 10/2012 | Johnson et al. | |
| 8,671,912 | B2 * | 3/2014 | Eisenmenger | F02M 47/027 123/456 |
| 9,410,522 | B2 * | 8/2016 | Rochas | F02M 63/025 |
| 9,581,120 | B2 * | 2/2017 | Morris | F02M 47/027 |
| 2009/0159727 | A1 * | 6/2009 | Eisenmenger | F02M 47/027 239/584 |
| 2012/0325936 | A1 * | 12/2012 | Rodriguez-Amaya | F02M 47/027 239/533.2 |
| 2014/0090247 | A1 | 4/2014 | Kosiorek | |
| 2015/0159607 | A1 * | 6/2015 | Magel | F02M 63/0029 239/533.8 |
| 2018/0340500 | A1 * | 11/2018 | Minixhofer | F02M 63/0075 |

FOREIGN PATENT DOCUMENTS

GB 1346501 A 2/1974

* cited by examiner

*Primary Examiner* — Jason J Boeckmann

(74) *Attorney, Agent, or Firm* — Faegre, Drinker, Biddle & Reath, LLP

(57) ABSTRACT

A fuel injector device for injecting fuel into a combustion chamber of an internal combustion engine is provided. Included in the fuel injector is a body having a chamber and a pilot valve assembly including a seat retainer configured to be detachably insertable into the chamber of the body. A pilot valve seat is disposed in the seat retainer and substantially enclosed by the seat retainer. A stator assembly is disposed in the seat retainer and at least partially enclosed by the seat retainer. The pilot valve seat and the stator assembly in the pilot valve assembly are replaceable as a single unit of the pilot valve assembly for the fuel injector.

15 Claims, 4 Drawing Sheets

FUEL INJECTOR HAVING A SELF-CONTAINED REPLACEABLE PILOT VALVE ASSEMBLY

FIELD OF THE DISCLOSURE

The present disclosure generally relates to common-rail fuel injector devices for injecting fuel into a combustion chamber of an internal combustion engine, and more particularly to a fuel injector having a self-contained replaceable pilot valve assembly.

BACKGROUND OF THE DISCLOSURE

An introduction of fuel into cylinders of an internal combustion engine is most commonly achieved using fuel injectors. A commonly used injector is a closed-nozzle injector which includes a nozzle assembly having a spring-biased needle valve element positioned adjacent the injector nozzle for allowing fuel to be injected into the cylinder of an internal combustion engine. The needle valve element also functions to provide a deliberate, abrupt end to fuel injection. The needle valve is positioned in the injector body and although biased downward by a spring force, a hydraulic force acting on the needle valve primarily holds the needle valve in the closed position. When an actuated force exceeds the biasing hydraulic force or causes a change in the magnitude of the hydraulic force, the needle valve element moves to allow fuel to pass through the injector nozzle, thus marking the beginning of the fuel injection event.

Manufacturers have implemented extra high pressure injection systems, also known as XPI, where the pressures can reach 2600 bar. Such high injection pressures cause wear and tear conditions in the injectors. During operation, the fuel injectors may need maintenance and/or replacement work depending on a degree of the wear and tear conditions of components of the injectors. Conventional injectors are typically serviceable only with special tools at designated service locations, and are difficult to replace, thereby increasing maintenance costs and time. Thus, vehicles having the injectors must be brought into the designated service locations and wait for the maintenance crew. Further, as injection pressures increase, greater forces must be applied to the injector components to achieve the required sealing at component interfaces/joints. Conventional injectors often include internal component configurations which are well suited to achieving desired high pressure performance characteristics but do so at high design and manufacturing costs. Accordingly, there is a need for an enhanced fuel injector that addresses one or more of the drawbacks of conventional injectors.

SUMMARY OF THE DISCLOSURE

In one embodiment of the present disclosure, a fuel injector includes a body having a chamber and a pilot valve assembly including a seat retainer configured to be detachably insertable into the chamber of the body. A pilot valve seat is disposed in the seat retainer and substantially enclosed by the seat retainer. A stator assembly is disposed in the seat retainer and at least partially enclosed by the seat retainer. The pilot valve seat and the stator assembly in the pilot valve assembly are replaceable as a single unit of the pilot valve assembly for the fuel injector.

In one aspect of the embodiment, no portion of the pilot valve seat is exposed outside of the seat retainer. In another aspect of the embodiment, the seat retainer and the stator assembly are integrated as a unitary unit. In one embodiment, a lower portion of the seat retainer includes a retainer central passage extending longitudinally from a lower end of the seat retainer toward an upper end of the seat retainer. The pilot valve seat includes a valve seat central passage extending longitudinally from a lower end of the pilot valve seat toward an upper end of the pilot valve seat. The valve seat central passage is fluidly coupled to the retainer central passage of the seat retainer. In another embodiment, an inner cavity within the chamber of the body is configured for receiving, at least partially, a lower end of the seat retainer.

In yet another aspect of the embodiment, the pilot valve assembly includes an armature assembly disposed in the seat retainer and a guide support disposed in the seat retainer between the armature assembly and the pilot valve seat. In one example, the stator assembly includes a solenoid disposed directly above the armature assembly, and the solenoid has an active state in which the armature assembly is in an upward position and an inactive state in which the armature assembly is in a downward position. In another example, the armature assembly is positioned within the chamber and includes a plunger central bore configured for receiving a plunger. In yet another example, the guide support has an inner bore configured to receive an armature spring and a lower end of the armature assembly. In one embodiment, a lower end of the guide support includes a radially inclined inner surface having a wider opening relative to a longitudinal axis of the guide support toward an edge of the lower end. In another embodiment, the radially inclined inner surface of the guide support is configured to matingly receive an upper portion of the pilot valve seat.

In another embodiment of the present disclosure, a fuel injector includes a body having an upper chamber and a lower chamber, and an armature assembly disposed in the upper chamber. A seat retainer having an inner chamber is configured to receive the armature assembly. A pilot valve seat is inserted into the inner chamber of the seat retainer. In one example, the pilot valve seat is attached to the seat retainer using at least one coupling mechanism to permit replacement of the pilot valve seat and the seat retainer as a single unit for the fuel injector.

In one aspect of the embodiment, the at least one coupling mechanism is a threaded fastener. In another aspect of the embodiment, the at least one coupling mechanism is a snap ring.

While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
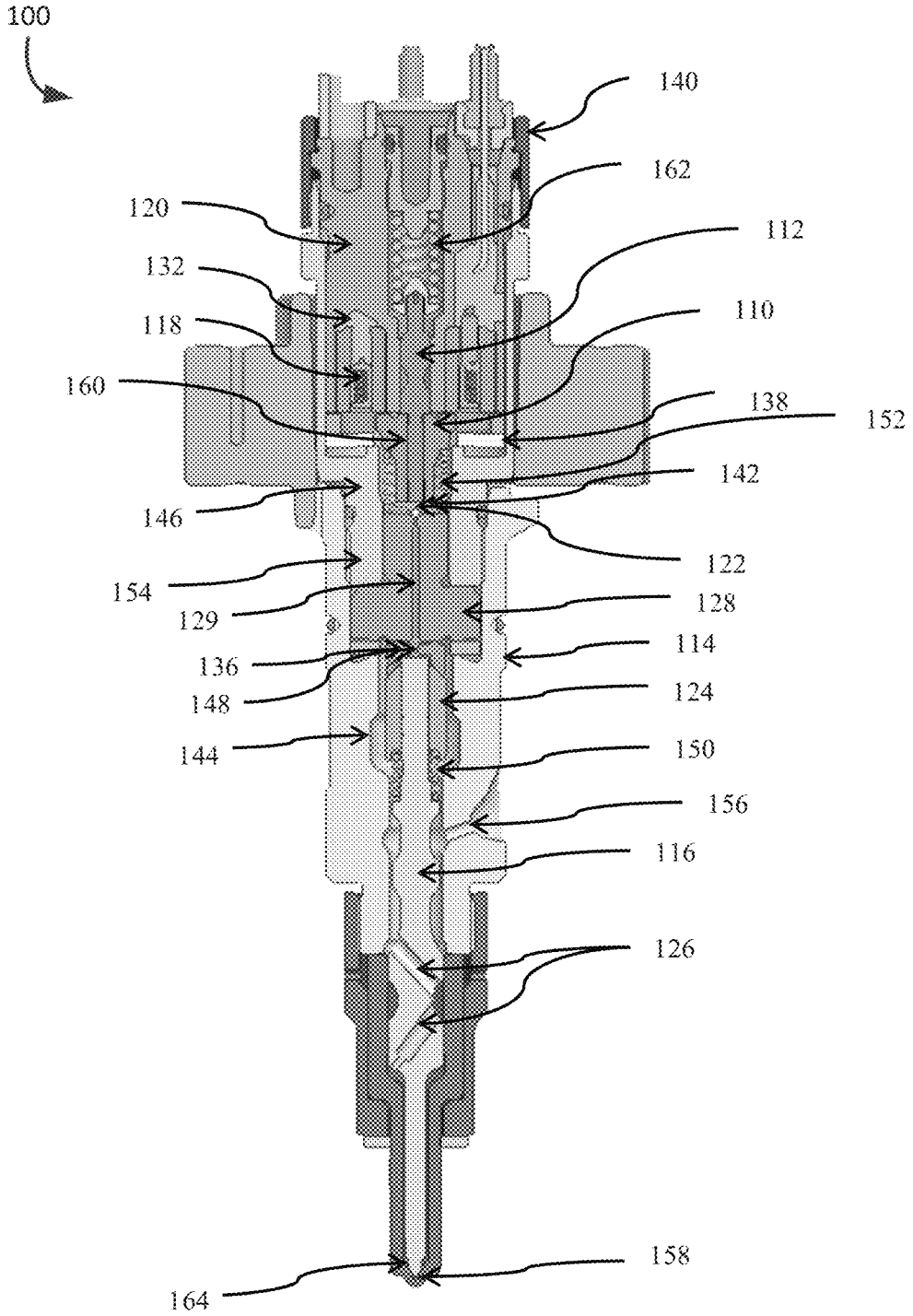
FIG. 1 Prior Art
FIG. 1 is a cross-sectional view of a prior art mid-range XPI fuel injector.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF EMBODIMENTS

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

FIG. 1 shows a cross-sectional view of a prior art mid-range XPI fuel injector 100. Fuel injector 100 generally includes an armature assembly 110, a plunger 112, an injector body 114, and a needle valve 116. Injector body 114 includes upper chamber 146 and lower chamber 144 for receiving a plurality of components therein. The disclosed embodiment provides an inner cavity within lower chamber 144 for receiving needle valve 116, a needle sleeve 124, a needle spring 150, a needle seal 136, a pilot valve seat 128, and a check ball 122. The disclosed embodiment further provides an inner cavity within upper chamber 146 for receiving armature assembly 110, plunger 112, an armature spring 152, a spring disk 138, and a stator assembly 120. Upper chamber 146 is a low pressure environment of fuel injector 100 relative to the high pressure environment below check ball 122.

Stator assembly 120 is fixed within the upper chamber 146 and retained in place by retainer 140. In the disclosed embodiment, the bottom surface of stator assembly 120 is a precision calibrated distance away from armature assembly 110. The other end of armature assembly 110 is supported via abutting engagement with check ball retainer 142.

The middle section of plunger 112 includes an angled shoulder disposed on the upper surface of armature assembly 110 thereby creating a reciprocal connection such that when armature assembly 110 moves in the upward direction plunger 112 moves therewith. Armature spring 152 is biased against the flanged elements of armature assembly 110 and biases armature assembly 110 and plunger 112 in an upward direction. Armature assembly 110 is positioned within an inner cavity of upper chamber 146 and further includes central bore 160 for receiving the shaft of plunger 112 there through. The outer diameter of the shaft of plunger 112 is sized and configured to provide a close or match fit in relation to the inner diameter of central bore 160 while still permitting sliding movement of plunger 112. This close/match fit inhibits fuel leakage between the outer diameter of the shaft of plunger 112 and the inner diameter of central bore 160 while permitting relative sliding movement.

Injector body 114 also includes lower chamber 144 which further includes an inner cavity that houses needle valve 116, needle sleeve 124, needle spring 150, needle seal 136, pilot valve seat 128, and check ball 122. Needle spring 150 biases needle valve 116 in a downward direction and applies a closing spring force to needle valve 116 thereby preventing fuel from exiting through injector orifice 158 when solenoid 132 is inactive. Needle seal 136 includes control orifices 148 integrated within the seal. Needle seal 136 is disposed above needle valve 116 and includes end points that terminate adjacent needle sleeve 124. The surface of the lower end of pilot valve seat 128 abuts the top surface of needle seal 136, while the surface of the upper end of pilot valve seat 128 is disposed immediately below armature spring 152. Pilot valve seat 128 further includes valve seat central passage 129. Valve seat central passage 129 extends longitudinally from the lower end of pilot valve seat 128 toward the upper end. Pilot valve seat 128 is held in place against the upwardly acting fuel pressure by a threaded seat retainer 154.

Lower chamber 144 further includes fuel entry orifice 156 which is configured to supply fuel to the inner cavity of lower chamber 144. The inner cavity as well as cross drilled fluid channels 126 in needle valve 116 facilitates fuel flow throughout lower chamber 144. The fuel supply pressure may be within a pressure range of approximately 500-2600 bar. Control orifices 148 function to route fuel flow up valve seat central passage 129. When coils 118 are de-energized and solenoid 132 is in an inactive state, check ball 122 is in sealing engagement with pilot valve seat 128. Check ball 122 also functions as a moveable valve member and thus moves out of sealing engagement with pilot valve seat 128. When check ball 122 is in sealing engagement with pilot valve seat 128, fuel from lower chamber 144 is blocked from entering upper chamber 146. When fuel is supplied to lower chamber 144 and check ball 122 is in sealing engagement with pilot valve seat 128 the inner cavity of lower chamber 144 becomes a highly pressurized volume. When check ball 122 functions as a moveable valve member and moves out of sealing engagement with pilot valve seat 128, high pressure fuel flows up valve seat central passage 129 through pilot valve seat 128 and into the inner cavity of upper chamber 146.

Injector 100 utilizes needle valve 116 in a normally closed position. When needle valve 116 is in its normally closed position, coils 118 are de-energized and solenoid 132 is in an inactive state. Additionally, plunger return spring 162 exerts a spring force downwardly such that plunger 112 and armature assembly 110 exert a downward force on check ball retainer 142 which thus secures and retains check ball 122 into sealing engagement with pilot valve seat 128. Pressurized fuel is continuously supplied to the inner cavity of lower chamber 144.

When coils 118 are de-energized fuel from lower chamber 144 is blocked from entering upper chamber 146 thus the inner cavity of lower chamber 144 becomes highly pressurized. Due to the fuel supply pressure acting downwardly on needle valve 116, a large downward hydraulic force pushes needle valve 116 in the downward direction. Needle spring 150 also is positioned in the inner cavity of lower chamber 144 and is compressed about the upper end of needle valve 116 such that when solenoid 132 is inactive, high pressure fuel as well as a downward spring force on needle valve 116 both act to secure needle valve 116 against needle valve seat 164. Securing needle valve 116 against needle valve seat 164 prevents high pressure fuel from exiting injector 100 via injector orifice 158.

For a fuel injection, injector 100 requires an intermediate pressure or force loss, such as depressurizing the pressurized control volume by creating a low pressure drain flow from the control volume. The beginning of an injection event is initiated by energizing coils 118 with an electric current. As coils 118 of solenoid 132 are energized the solenoid acts as a type of electromagnet which then causes armature assembly 110 to rapidly move upwardly in magnetic attraction with solenoid 132. Because plunger 112 is disposed atop armature assembly 110, the strength of the solenoid's magnetic force acting on armature assembly 110 further causes plunger 112 to move upwardly against the downward biasing force of plunger return spring 162. When coils 118 are energized solenoid 132 is in an active state thereby causing armature assembly 110 and plunger 112 to move to an upward position, permitting movement of check ball 122 out of sealing engagement with pilot valve seat 128. During an injection event, check ball 122 functions as a moveable valve member, and when it moves out of sealing engagement with pilot valve seat 128, high pressure fuel residing in valve seat central passage 129 flows through pilot valve seat 128 into the inner cavity of upper chamber 146.

The flow of high pressure fuel from the inner cavity of lower chamber 144 to the inner cavity of upper chamber 146 creates a pressure differential. The pressure difference between the high fuel supply pressure in lower chamber 144 and the low pressure in upper chamber 146 results in significant hydraulic force acting in a direction to lift needle valve 116 and allow an injection event. Needle valve 116 is therefore lifted off needle valve seat 164 allowing fuel to be injected into the engine combustion chamber via injector orifice 158 which may contain various spray outlet arrangements.

The fuel injection event is ended by de-energizing coils 118, which results in solenoid 132 being inactive and thus causing the downward force of plunger return spring 162 to force plunger 112 to exert a downward force on armature assembly 110. The downward force exerted on armature assembly 110 via plunger return spring 162 forces check ball 122 back into sealing engagement with pilot valve seat 128. When check ball 122 is in sealing engagement with pilot valve seat 128, high pressure fuel from lower chamber 144 is once again blocked from entering the inner cavity of upper chamber 146. As fuel is continuously supplied to lower chamber 144 and with check ball 122 in sealing engagement with pilot valve seat 128, the inner cavity of lower chamber 144 again becomes highly pressurized. The seal created by check ball 122 as well as the high pressure fuel supplied to the inner cavity of lower chamber 144 both combine to produce a highly pressurized control volume in lower chamber 144. Due to the fuel supply pressure acting downwardly on needle valve 116, a large downward hydraulic force pushes needle valve 116 back to the downward direction. Needle spring 150 further applies a downward biasing spring force in order to expedite seating needle valve 116 against needle valve seat 164, thus preventing high pressure fuel from exiting injector 100 and ending the injection event.

Figure 2:
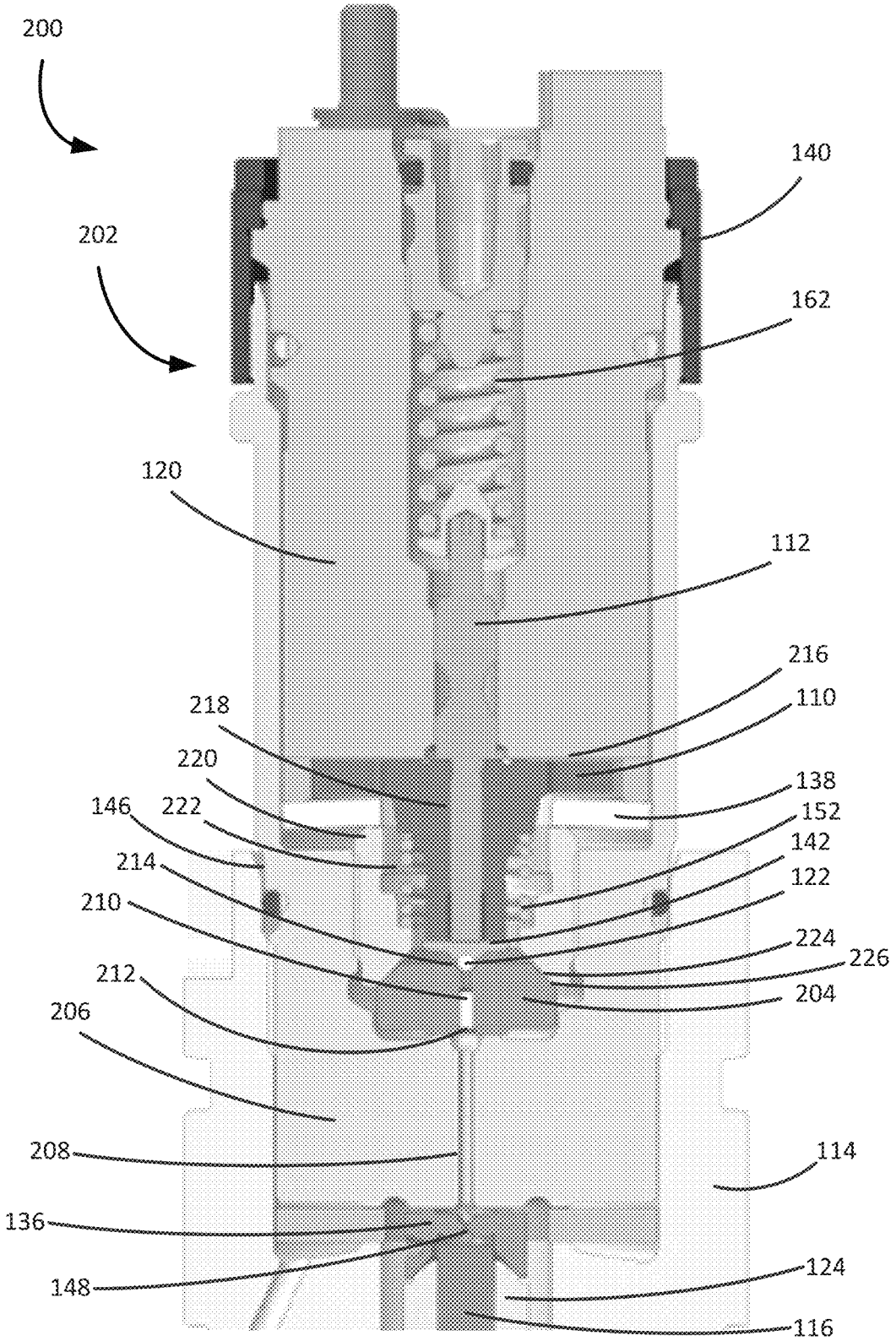
FIG. 2 is a partial cross-sectional view of an exemplary embodiment of a common rail fuel injector featuring a self-contained replaceable pilot valve assembly in accordance with embodiments of the present disclosure.

FIG. 2 shows an exemplary embodiment of the present disclosure designed to overcome one or more shortcomings of conventional injectors and/or offer features noted herein below. Like reference numerals represent like elements shown in FIG. 1. Fuel injector 200 includes a self-contained replaceable pilot valve assembly 202 being detachably insertable into upper chamber 146 of injector body 114. Advantageously, self-contained replaceable pilot valve assembly 202 is readily exchangeable from fuel injector 200 to another injector as desired. In this configuration, stator assembly 120 and a pilot valve seat 204 are constructed and arranged to be replaceable as a single unit in self-contained replaceable pilot valve assembly 202. As such, self-contained replaceable pilot valve assembly 202 is exchangeable while operating in the field without having to be replaced in the designated service locations by the maintenance crew. Another advantage is that self-contained replaceable pilot valve assembly 202 can also be installed in a conventional injector, such as fuel injector 100. In other words, originals parts of the conventional injector can be removed and exchanged with self-contained replaceable pilot valve assembly 202 out in the field.

More specifically, pilot valve seat 204 of fuel injector 200 is smaller than pilot valve seat 128 of fuel injector 100, and is disposed within a seat retainer 206 of self-contained replaceable pilot valve assembly 202. Seat retainer 206 can be threadably attached to injector body 114, but can also be attached by, for example, glue, friction fit, snap fit, or other similar rigid coupling mechanism. In this example, pilot valve seat 204 is substantially enclosed by seat retainer 206 such that no portion of pilot valve seat 204 is exposed outside of seat retainer 206. In another example, pilot valve seat 204 is fully enclosed by seat retainer 206. For example, seat retainer 206 and stator assembly 120 are fully integrated as a unitary unit. In contrast, as shown in FIG. 1, a lower portion of pilot valve seat 128 of fuel injector 100 is exposed out of threaded retainer 154. This particular configuration of pilot valve seat 204 and seat retainer 206 allows for easy replacement of damaged or worn-out self-contained replaceable pilot valve assembly 202. A lower portion of seat retainer 206 includes a retainer central passage 208 extending longitudinally from a lower end of seat retainer 206 toward an upper end of seat retainer 206. When assembled, a valve seat central passage 210 of pilot valve seat 204 is fluidly coupled to retainer central passage 208 of seat retainer 206 such that fuel can flow up from control orifices 148 of needle seal 136 to an inner chamber of seat retainer 206 via retainer central passage 208 and valve seat central passage 210.

Self-contained replaceable pilot valve assembly 202 generally includes pilot valve seat 204, seat retainer 206, armature assembly 110, plunger 112, stator assembly 120, and a guide support 220. Other components, such as check ball 122, check ball retainer 142, armature spring 152, spring disk 138, and the like, as shown in FIG. 2, are also included in self-contained replaceable pilot valve assembly 202. Pilot valve seat 204 further includes an inlet end 212, an outlet end 214, and valve seat central passage 210. As discussed above, injector body 114 includes upper chamber 146 and lower chamber 144 for receiving a plurality of components therein, such as self-contained replaceable pilot valve assembly 202. The disclosed embodiment provides an inner cavity within upper chamber 146 for receiving stator assembly 120, solenoid 132, coil 118, armature spring 152, and plunger return spring 162. In this example, an inner cavity within upper chamber 146 is configured for receiving, at least partially, the lower end of seat retainer 206. As with fuel injector 100, upper chamber 146 is a low pressure environment of fuel injector 200 relative to the high pressure environment below pilot valve seat 204 and the lower end of seat retainer 206.

In one embodiment, a bottom surface of stator assembly 120 has a precision calibrated distance from one end of armature assembly 110. The distance between stator assembly 120 and armature assembly 110 is indicated by a stroke gap 216. An exemplary distance of stroke gap 216 is approximately 47 microns. After extended use of fuel injector 200, the distance of stroke gap 216 can change over time (e.g., become larger or smaller) causing an inaccurate operation of the fuel injection event. Recalibrating stroke gap 216 in the field can be difficult without proper tools. However, it is advantageous that an old self-contained replaceable pilot valve assembly 202 can readily be replaced with a new self-contained replaceable pilot valve assembly 202 for either fuel injector 200 or fuel injector 100.

Stator assembly 120 further includes solenoid 132 disposed directly above armature assembly 110, wherein solenoid 132 has an active state in which armature assembly 110 moves to an upward position and an inactive state in which armature assembly 110 moves to a downward position. Armature assembly 110 is positioned within the inner cavity of upper chamber 146 and further includes a plunger central bore 218 for receiving plunger 112 there through.

Plunger 112 includes a shaft portion disposed within plunger central bore 218 of armature assembly 110 for creating a reciprocal connection such that when armature assembly 110 moves in the upward direction, plunger 112 moves therewith. An outer diameter of the shaft of plunger 112 is sized and configured to provide a close or match fit in relation to an inner diameter of plunger central bore 218 while still permitting sliding movement of plunger 112. This close/match fit inhibits fuel leakage between the outer diameter of the shaft of plunger 112 and the inner diameter of plunger central bore 218 while permitting relative sliding movement. Armature assembly 110 further includes flanged elements disposed directly below solenoid 132 and coils 118. Armature spring 152 is biased against the flanged elements of armature assembly 110 and biases armature assembly 110 and plunger 112 in an upwardly direction.

Guide support 220 is disposed below the flanged elements of armature assembly 100 between spring disk 138 and pilot valve seat 204, and has an inner bore 222 configured to receive armature spring 152 and a lower end of armature assembly 110. In one embodiment, a lower end of guide support 220 includes a radially inclined inner surface 224 having a wider opening relative to a longitudinal axis of guide support 220 toward an edge of the lower end. Radially inclined inner surface 224 is configured to matingly receive an upper portion of pilot valve seat 204 having a corresponding sloped or angled outer surface 226 such that pilot valve seat 204 is securely held by guide support 220 during operation.

As similarly with fuel injector 100, when coils 118 are de-energized and solenoid 132 is in an inactive state, check ball 122 is in sealing engagement with pilot valve seat 204. Check ball 122 also functions as a moveable valve member and thus moves out of sealing engagement with pilot valve seat 204. When check ball 122 is in sealing engagement with pilot valve seat 204, fuel from lower chamber 144 is blocked from entering upper chamber 146. When fuel is supplied to lower chamber 144 and check ball 122 is in sealing engagement with pilot valve seat 204, the inner cavity of lower chamber 144 becomes a highly pressurized volume. When check ball 122 functions as a moveable valve member and moves out of sealing engagement with pilot valve seat 204, high pressure fuel flows up retainer central passage 208 and valve seat central passage 210 and into the inner chamber of seat retainer 206.

When coils 118 are energized solenoid 132 is in an active state thereby causing armature assembly 110 and plunger 112 to move to an upward position, permitting movement of check ball 122 out of sealing engagement with pilot valve seat 204. During an injection event, check ball 122 functions as a moveable valve member, and when it moves out of sealing engagement with pilot valve seat 204, high pressure fuel residing in retainer central passage 208 and valve seat central passage 210 flows through seat retainer 206 and pilot valve seat 204 into the inner chamber of seat retainer 206.

Figure 3:
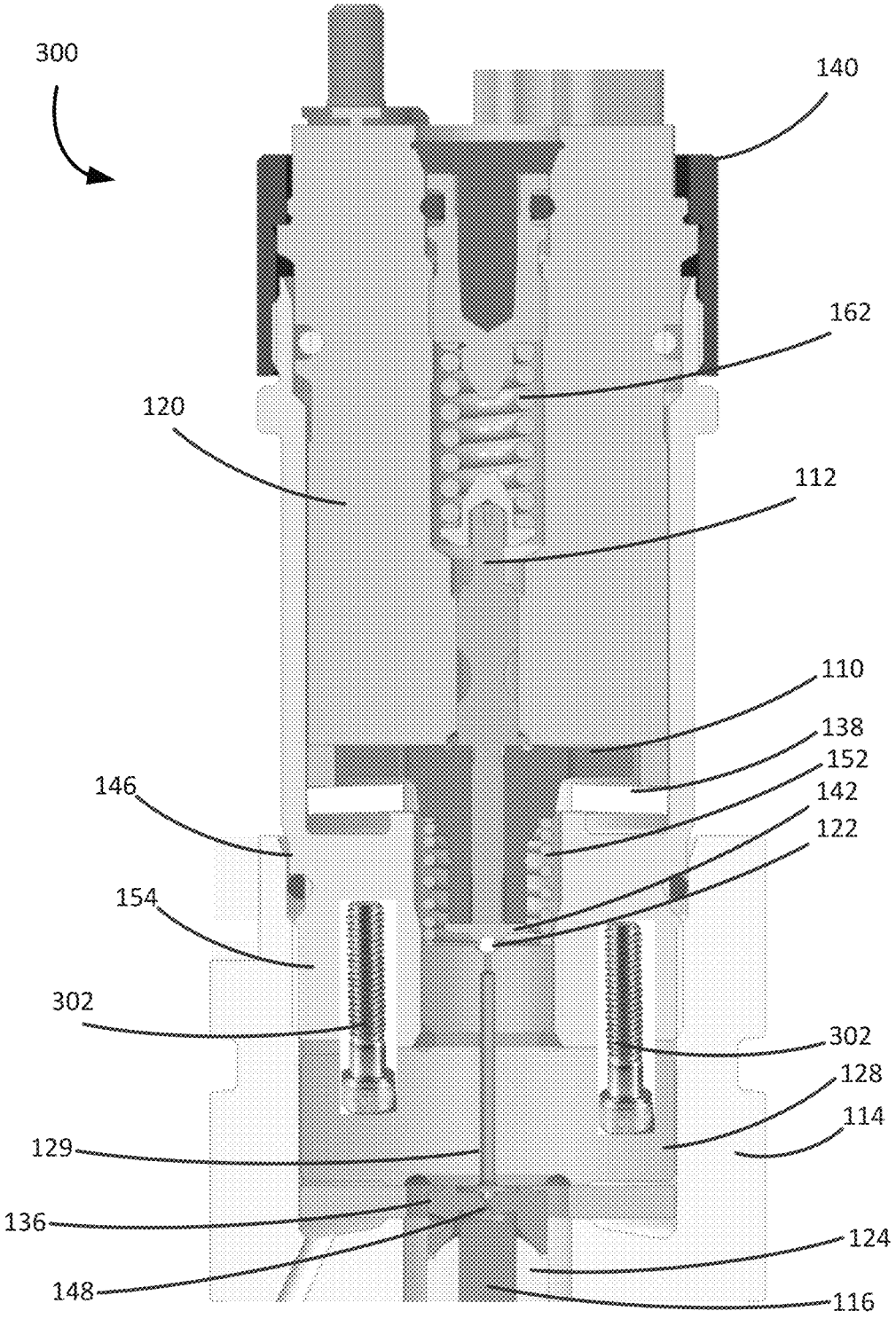
FIG. 3 is a partial cross-sectional view of another embodiment of a common rail fuel injector featuring a first connecting mechanism in accordance with embodiments of the present disclosure.

FIG. 3 is a cross-sectional view of fuel injector 300 which includes a plurality of fasteners 302 according to the present disclosure. Fuel injector 300 is a variant of fuel injector 200 and generally includes elements of fuel injector 100. Like reference numerals represent like elements shown in FIG. 1. One aspect of fuel injector 300 is that a first coupling mechanism, such as fasteners 302, are used to fixedly and removably attach threaded retainer 154 to pilot valve seat 128. In this example, fasteners 302 are threaded bolts, but any other suitable fastener types known in the art can be used to suit different applications. In this configuration, components associated with threaded retainer 154 and pilot valve seat 128 are replaceable as a single unit.

Figure 4:
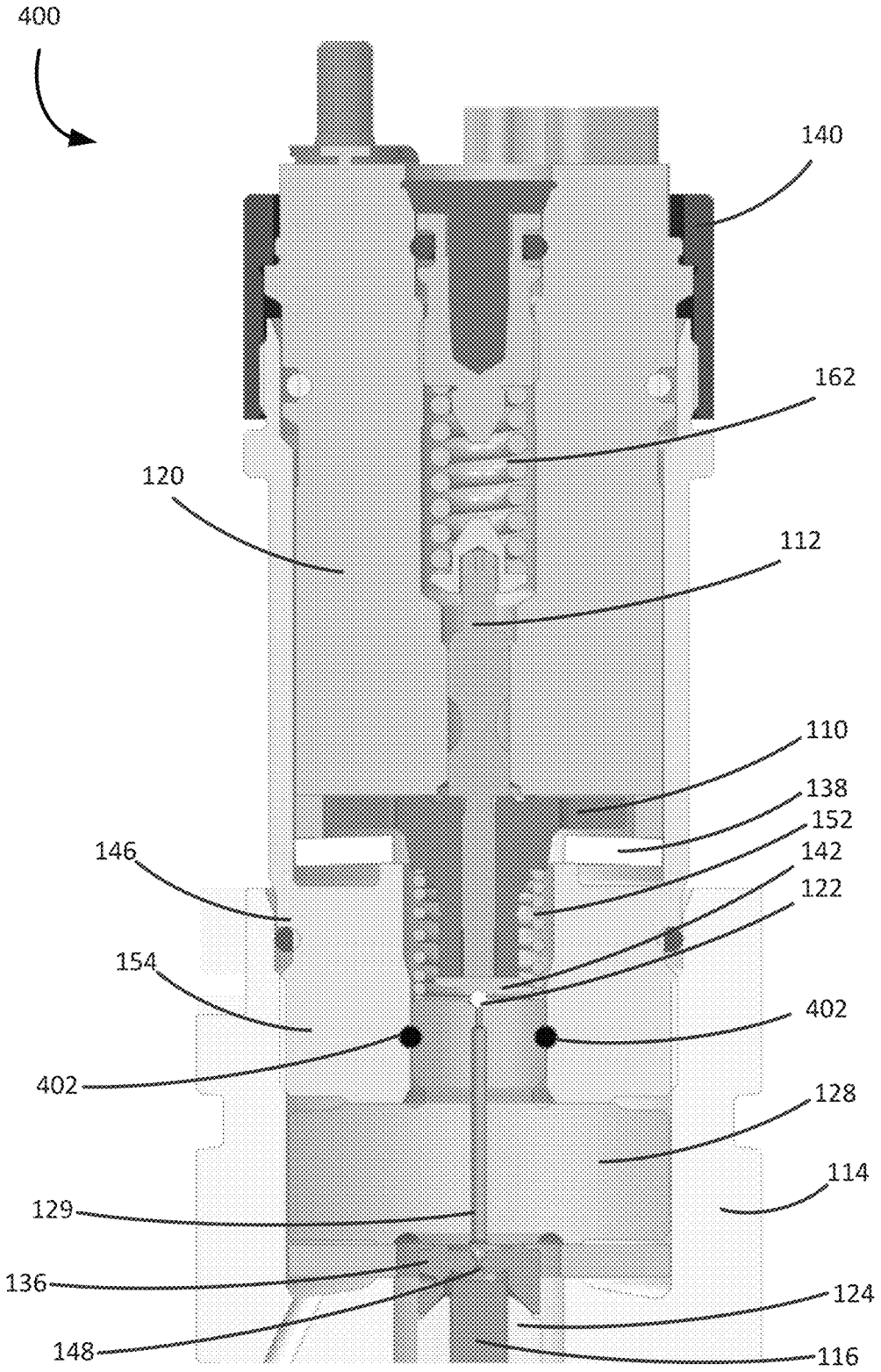
FIG. 4 is a partial cross-sectional view of yet another embodiment of a common rail fuel injector featuring a second connecting mechanism in accordance with embodiments of the present disclosure.

FIG. 4 is a cross-sectional view of fuel injector 400 which includes at least one snap ring 402 according to the present disclosure. Fuel injector 400 is another variant of fuel injector 200 and generally includes elements of fuel injector 100. Like reference numerals represent like elements shown in FIG. 1. One aspect of fuel injector 400 is that a second coupling mechanism, such as a snap ring 402, is used to fixedly and removably attach threaded retainer 154 to pilot valve seat 128. In this example, snap ring 402 is disposed between an inner surface of threaded retainer 154 and an outer surface of pilot valve seat 128 for facilitating secure attachment between threaded retainer 154 and pilot valve seat 128. Again, in this configuration, components associated with threaded retainer 154 and pilot valve seat 128 are replaceable as a single unit.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in associate with another embodiment. The scope of the present disclosure should, therefore, be determined with reference to the appended claims, along with the full scope of equivalents to which such claims are entitled.

What is claimed is:

1. A fuel injector, comprising:

an injector body having a chamber in contact with fuel inside the chamber, the injector body including an integrated needle sleeve for receiving a needle valve;

a pilot valve assembly including a seat retainer configured to be detachably insertable into the chamber of the injector body and an armature assembly and a guide support disposed in the seat retainer, the seat retainer extending outside of the chamber of the injector body when inserted into the chamber of the injector body;

a pilot valve seat disposed in the seat retainer and substantially enclosed by the seat retainer, the seat retainer substantially enclosing the pilot valve seat by enclosing a lower portion of the pilot valve seat to be fully within the seat retainer; and a stator assembly disposed in the seat retainer, the stator assembly being in contact with a portion of the seat retainer and at least partially enclosed by the portion of the seat retainer in contact with the stator assembly;

wherein:

a lower end of the guide support includes a radially inclined inner surface in contact with an upper portion of the pilot valve seat having a corresponding radially inclined outer surface, the radially inclined inner surface having a wider opening relative to a longitudinal axis of the guide support, toward an edge of the lower end;

each of the seat retainer, the pilot valve seat, the stator assembly, and the armature assembly includes a central axis aligned to each other; and the stator assembly, the pilot valve seat, and the armature assembly are replaceable as a single unit for the fuel injector.

2. The fuel injector of claim 1, wherein no portion of the pilot valve seat is exposed outside of the seat retainer.

3. The fuel injector of claim 1, wherein the seat retainer and the stator assembly are integrated as a unitary unit.

4. The fuel injector of claim 1, wherein a lower portion of the seat retainer includes a retainer central passage extending longitudinally from a lower end of the seat retainer toward an upper end of the seat retainer.

5. The fuel injector of claim 4, wherein the pilot valve seat includes a valve seat central passage extending longitudinally from a lower end of the pilot valve seat toward an upper end of the pilot valve seat.

6. The fuel injector of claim 5, wherein the valve seat central passage is fluidly coupled to the retainer central passage of the seat retainer.

7. The fuel injector of claim 1, wherein the chamber of the injector body is configured for receiving, at least partially, a lower end of the seat retainer.

8. The fuel injector of claim 1, wherein the guide support is disposed between the armature assembly and the pilot valve seat.

9. The fuel injector of claim 8, wherein the stator assembly includes a solenoid disposed directly above the armature assembly, and the solenoid has an active state in which the armature assembly is in an upward position and an inactive state in which the armature assembly is in a downward position.

10. The fuel injector of claim 8, wherein the armature assembly is positioned within the chamber and includes a plunger central bore configured for receiving a plunger.

11. The fuel injector of claim 8, wherein the guide support, has an inner bore configured to receive an armature spring and a lower end of the armature assembly.

12. A pilot valve assembly used in a fuel injector, the pilot valve assembly comprising:

a seat retainer having an inner chamber configured to be detachably insertable into a chamber of an injector body of the fuel injector, a lower portion of the seat retainer including a retainer central passage and the seat retainer extending outside of the chamber of the injector body when inserted into the chamber of the injector body;

a stator assembly disposed in the inner chamber of the seat retainer, the stator assembly being in contact with a portion of the seat retainer and at least partially enclosed by the portion of the seat retainer in contact with the stator assembly;

a pilot valve seat disposed in the inner chamber of the seat retainer and substantially enclosed by the seat retainer, the seat retainer substantially enclosing the pilot valve seat by enclosing a lower portion of the pilot valve seat to be fully within the seat retainer such that the pilot valve seat does not extend into the retainer central passage;

an armature assembly disposed between the stator assembly and the pilot valve seat configured to facilitate reciprocal movement within the inner chamber of the seat retainer, a guide support disposed in the inner chamber of the seat retainer between the armature assembly and the pilot valve seat, a lower end of the guide support including a radially inclined inner surface having a wider opening relative to a longitudinal axis of the guide support toward an edge of the lower end, the radially inclined inner surface being in contact with an upper portion of the pilot valve seat having a corresponding radially inclined outer surface;

wherein:

each of the seat retainer, the pilot valve seat, the stator assembly, and the armature assembly includes a central axis aligned to each other; and the stator assembly, the pilot valve seat, and the armature assembly disposed, at least partially, in the inner chamber of the seat retainer are replaceable as a single unit for the fuel injector.

13. The pilot valve assembly of claim 12, wherein the retainer central passage extends longitudinally from a lower end of the seat retainer toward an upper end of the seat retainer.

14. The pilot valve assembly of claim 13, wherein the pilot valve seat includes a valve seat central passage extending longitudinally from a lower end of the pilot valve seat toward an upper end of the pilot valve seat such that the valve seat central passage is fluidly coupled to the retainer central passage of the seat retainer.

15. A fuel injector, comprising:

an injector body having a chamber in contact with fuel inside the chamber, the injector body including an integrated needle sleeve for receiving a needle valve;

a pilot valve assembly including a seat retainer configured to be detachably insertable into the chamber of the injector body and an armature assembly and a guide support disposed in the seat retainer, the seat retainer extending outside of the chamber of the injector body when inserted into the chamber of the injector body;

a pilot valve seat disposed in the seat retainer and substantially enclosed by the seat retainer, the seat retainer substantially enclosing the pilot valve seat by enclosing a lower portion of the pilot valve seat to be fully within the seat retainer;

a plunger positioned above the pilot valve seat and extending through the armature assembly; and a stator assembly disposed in the seat retainer, the stator assembly being in contact with a portion of the seat retainer and at least partially enclosed by the portion of the seat retainer in contact with the stator assembly;

wherein:

a lower end of the guide support includes a radially inclined inner surface in contact with an upper portion of the pilot valve seat having a corresponding radially inclined outer surface, the radially inclined inner surface having a wider opening relative to a longitudinal axis of the guide support toward an edge of the lower end;

each of the seat retainer, the pilot valve seat, the stator assembly, and the armature assembly includes a central axis aligned to each other; and the stator assembly, the pilot valve seat, and the armature assembly are replaceable as a single unit for the fuel injector.

* * * * *